US010694911B2

(12) United States Patent
Lee et al.

(10) Patent No.: US 10,694,911 B2
(45) Date of Patent: Jun. 30, 2020

(54) VACUUM CLEANER

(71) Applicant: LG ELECTRONICS INC., Seoul (KR)

(72) Inventors: Changhoon Lee, Seoul (KR); Gunho Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 721 days.

(21) Appl. No.: 14/721,711

(22) Filed: May 26, 2015

(65) Prior Publication Data

US 2015/0366425 A1 Dec. 24, 2015

(30) Foreign Application Priority Data

Jun. 24, 2014 (KR) ..... 10-2014-0077107

(51) Int. Cl.
*A47L 9/28* (2006.01)

(52) U.S. Cl.
CPC ..... *A47L 9/2884* (2013.01); *A47L 9/2842* (2013.01); *A47L 9/2857* (2013.01); *A47L 9/2868* (2013.01); *A47L 9/2873* (2013.01)

(58) Field of Classification Search
CPC .... A47L 9/2842; A47L 9/2884; A47L 9/2868; A47L 2201/022; A47L 11/4005; H02J 7/02; H02J 7/022
USPC ..... 15/319, 339; 320/137
See application file for complete search history.

(56) References Cited

U.S. PATENT DOCUMENTS

| | | | | |
|---|---|---|---|---|
| 6,664,748 | B2 * | 12/2003 | Kushida | A47L 9/2805 15/319 |
| 7,379,313 | B2 | 5/2008 | Yaguchi | |
| 2002/0174506 | A1 * | 11/2002 | Wallach | A47L 5/36 15/319 |
| 2006/0267552 | A1 * | 11/2006 | Baer | H02J 7/342 320/128 |
| 2007/0136984 | A1 * | 6/2007 | Hsu | A47L 5/28 15/339 |
| 2013/0162194 | A1 * | 6/2013 | Woo | H02J 50/90 320/101 |

FOREIGN PATENT DOCUMENTS

| | | | |
|---|---|---|---|
| CN | 1386471 | A | 12/2002 |
| CN | 1906836 | A | 1/2007 |
| JP | 2002045320 | A | 2/2002 |
| JP | 2005013382 | A | 1/2005 |
| JP | 2007105275 | A | 4/2007 |
| JP | 2007203101 | A | 8/2007 |
| JP | 4836538 | B2 | 12/2011 |
| KR | 20010003120 | A | 1/2001 |
| WO | 2005/081387 | A1 | 9/2005 |

(Continued)

*Primary Examiner* — Orlando E Aviles
*Assistant Examiner* — Thomas Raymond Rodgers
(74) *Attorney, Agent, or Firm* — Dentons US LLP

(57) ABSTRACT

Provided is a vacuum cleaner. The vacuum cleaner includes a cleaner body including a suction motor for generating a suction force, a suction part communicating with the cleaner body to suction air and dusts, at least one battery disposed in the cleaner body or suction part to supply a power to the suction motor, and a controller controlling an operation of the suction motor. The controller control an output of the suction motor according to a voltage of the at least one battery.

3 Claims, 6 Drawing Sheets

(56) References Cited

FOREIGN PATENT DOCUMENTS

| | | | | |
|---|---|---|---|---|
| WO | 2005081387 | A1 | 9/2005 | |
| WO | 2014000794 | A1 | 1/2014 | |
| WO | WO 2014000794 | A1 * | 1/2014 | ..... H02P 7/00 |

* cited by examiner

VACUUM CLEANER

CROSS-REFERENCE TO RELATED APPLICATIONS

The present application claims priority under 35 U.S.C. 119 and 35 U.S.C. 365 to Korean Patent Application No. 10-2014-0077107 (filed on Jun. 24, 2014), which is hereby incorporated by reference in its entirety.

BACKGROUND

In general, vacuum cleaners are devices that suction air containing dusts by using a suction force generated by a suction motor mounted in a main body to filter the dusts in the main body.

Vacuum cleaners are classified into manual cleaners and automatic cleaners. The manual cleaners are cleaners that are used for directly performing cleaning by a user, and the automatic cleaners that travel by oneself to perform cleaning.

The manual cleaners may be classified into a canister type cleaner in which a suction nozzle is provided separately with respect to a main body and connected to the main body by using a connection tube and an upright type cleaner in which a suction nozzle is coupled to a main body.

A power cord outlet of a cleaner is disclosed in Korean Patent Publication No. 10-2006-0118796 (Published Date: Nov. 24, 2006).

According to the prior document, since a cord reel assembly is provided in a main body, and a power cord is connected to a socket, the main body may receive a power.

In the prior document, since a cleaner receives a power through the cord reel assembly, the cleaner may move by only a distance corresponding to a length of the cord wound around the cord reel assembly when the cleaner performs cleaning.

SUMMARY

Embodiments relate to a vacuum cleaner.

In one embodiment, a vacuum cleaner includes: a cleaner body including a suction motor for generating a suction force; a suction part communicating with the cleaner body to suction air and dusts; at least one battery disposed in the cleaner body or suction part to supply a power to the suction motor; and a controller controlling an operation of the suction motor, wherein the controller control an output of the suction motor according to a voltage of the at least one battery.

In another embodiment, a vacuum cleaner includes: a cleaner body; a suction part communicating with the cleaner body to suction air and dusts; a first battery disposed on the cleaner body or the suction part, the first battery having a first maximum charging voltage; a second battery disposed on the cleaner body or the suction part, the second battery having a second maximum charging voltage that is less than the first maximum charging voltage; a first driving part receiving a power from the first battery; and a second driving part receiving a power from the second battery.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
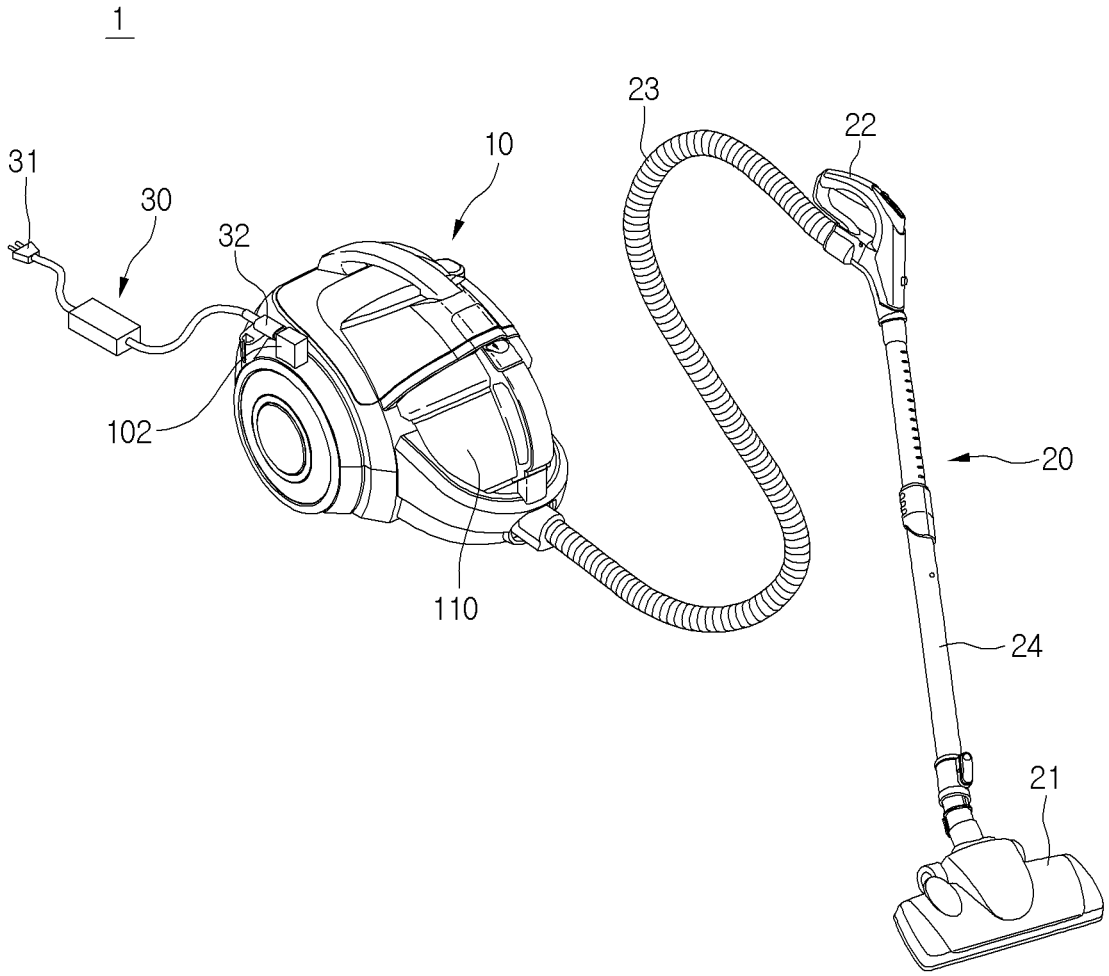
FIG. 1 is a perspective view of a vacuum cleaner according to a first embodiment.
Figure 2:
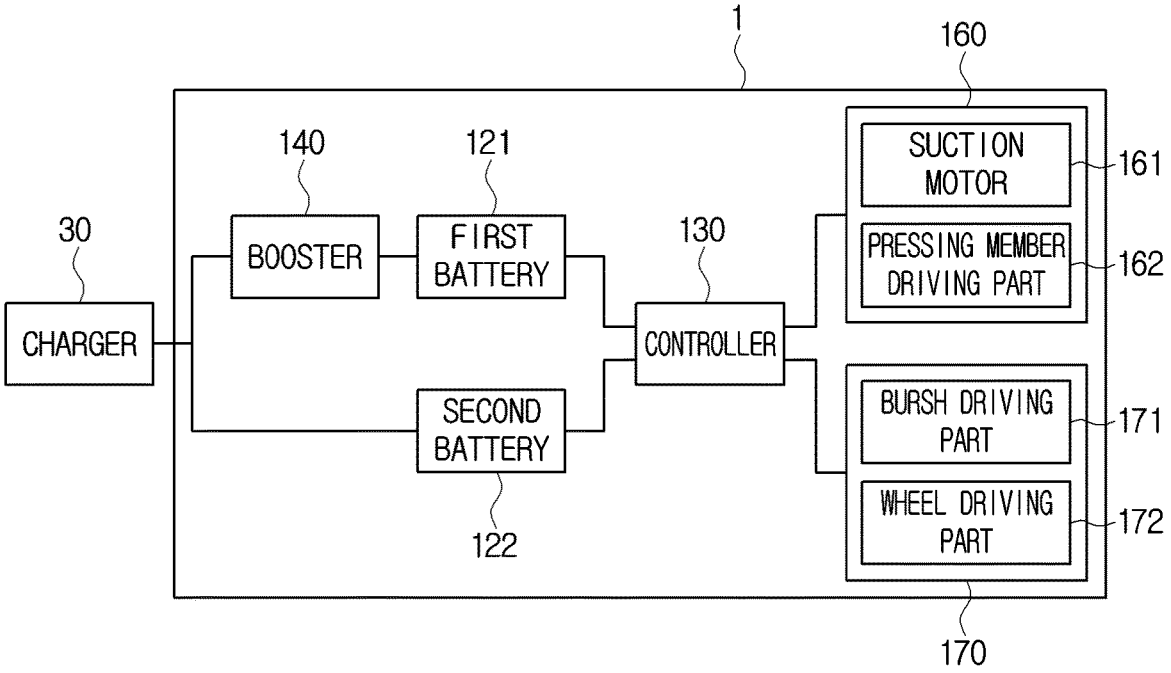
FIG. 2 is a block diagram of the vacuum cleaner according to the first embodiment.

FIG. 1 is a perspective view of a vacuum cleaner according to a first embodiment, and FIG. 2 is a block diagram of the vacuum cleaner according to the first embodiment.

Referring to FIGS. 1 and 2, a vacuum cleaner 1 according to the first embodiment may include a cleaner body 10 and a suction device 20 for guiding air containing dusts into the cleaner body 10.

The suction device 20 may include a suction part 21 for suctioning dusts disposed on a surface to be cleaned, for example, a bottom surface and connection parts 22, 23, and 24 for connecting the suction part 21 to the cleaner body 10.

The connection part 22, 23, and 24 may include an extension tube 24 connected to the suction part 21, a handle 22 connected to the extension part 24, and a suction hose 23 connecting the handle 22 to the cleaner body 10.

Also, the vacuum cleaner 1 may further include a dust separation part (not shown) for separating dusts from air suctioned by the suction device 20 and a dust container 110 for storing the dusts separated by the dust separation part. The dust container 110 may be separably mounted on the cleaner body 10. The dust separation part may be provided as a separate part that is separated from the dust container 110 or be provided as one module together with the dust container 110.

The vacuum cleaner 1 may include a plurality of driving parts 160 and 170 that receive a power to operate.

The vacuum cleaner 1 may further include a plurality of batteries 121 and 122 supplying a power for operating the plurality of driving parts 160 and 170 and a charger 30 separably connected to the cleaner body 10 to charge the plurality of batteries 121 and 122.

The charger 30 may include a power cord 31 connected to a socket and a charger connector 32 connected to the cleaner body 10. Also, the cleaner body 10 may include a cleaner connector 102 connected to the charger connector 32. For another example, the cleaner connector 102 may be provided on the suction part 102. The cleaner connector 102 may protrude from the cleaner body 10 or the suction part 21.

The plurality of batteries 121 and 122 may be disposed on at least one of the cleaner body 10 and the suction part 21. For example, all of the plurality of batteries 121 and 122 may be disposed on the cleaner body 10 or the suction part 21. Alternatively, a portion of the plurality of batteries 121 and 122 may be disposed on the suction part 21, and the other portion may be disposed on the cleaner body 10.

The charger 30 may perform rectification and smoothing operations to convert a commercial AC voltage into a DC voltage. Also, the charger 30 may supply the converted DC voltage to the cleaner connector 102. For example, the charger 30 may convert the commercial AC voltage into a DC voltage of about 42.4 V or less to supply the converted DC voltage to the cleaner connector 102.

Thus, since the DC voltage of about 42.4 V or less is outputted from the charger connector 32 of the charger 30, there is no problem in user safety even though an insulation device is not provided to the charger connector 32. Alternatively, the insulation device may be provided to the charger connector 32.

The plurality of batteries 121 and 122 may include a first battery 121 having a first maximum charging voltage and a second battery 122 having a second maximum charging voltage. Here, the first maximum charging voltage is greater than the second maximum charging voltage.

Each of the batteries 121 and 122 may include a plurality of unit cells that are connected to each other in series. The plurality of unit cells may be maintained and managed to a predetermined voltage by a battery management system (BMS) (now shown). That is, the BMS may allow each of the batteries 121 and 122 to output the predetermined voltage. Each of the batteries 121 and 122 may be a chargeable and dischargeable secondary battery.

Although not limited, the first maximum charging voltage may be greater than that of about 42.4 V, and the second maximum charging voltage may be equal to or less than that of about 42.4V. For example, the first maximum charging voltage may be above about 84.8 V.

The plurality of driving parts 160 and 170 may include a first driving part receiving a power from the first battery 121 and a second driving part 170 receiving a power from the second battery 122.

For example, the first driving part 160 may include a suction motor 161 that operates until an operation start command is inputted, and an operation stop command is inputted.

Also, the first driving part 160 may further include a pressing member driving part 162 turned on/off by being interlocked with the suction motor 161. A pressing member 163 for pressing dusts stored in the dust container 110 may be disposed in the dust container 110. The pressing member driving part 162 may drive the pressing member 163. However, the pressing member may be omitted in the dust container 110. In this case, the pressing member driving part 162 may be omitted. In this specification, the first driving part 160 may be called an always-on driving part that is driven always.

The second driving part 170 may be called an intermittent driving part that operates only when a specific condition is satisfied. That is, the second driving part 170 may be switched from a turn-on state into a turn-off state or from the turn-off state into the turn-on state while the first driving part 160 operates.

Although not limited, the second driving part 170 may include at least one of a brush driving part 171 for driving a brush 173 disposed on the suction nozzle 21 and a wheel driving part 172 for driving a wheel 105 for moving the cleaner body 10.

In the current embodiment, the suction motor 161 may be, for example, a BLDC motor. Also, the suction motor 161 may have a maximum output of about 600 W or more, but is not limited thereto.

When the maximum voltage charged in the battery 121 is below about 42.4 V, current of minimum 14.15 A or more has to be applied to operate the high-output suction motor 161. As a result, a circuit required for operating the suction motor 161 may be complicated.

However, in the current embodiment, the high-output suction motor 161 may operate by using the voltage charged in the first battery 121, which has the maximum charging voltage, of the plurality of batteries 121 and 122.

Here, to charge the first battery 121, the cleaner body 10 or the suction part 21 may further include a booster 140 for receiving a DC voltage of about 42.4 V or less from the charger 30 to boost the received DC voltage and provide the boosted voltage to the first battery 121. The booster 140 may include, for example, a boost converter 140 (or a DC/DC converter).

The boost converter may include an inductor, a diode, a capacitor, and a switching device. Also, the switching device may be quickly and repeatedly turned on/off by the control of a controller 130 to allow the boost converter to boost an input voltage.

Here, the switching device may include a MOSFET, but is not limited thereto. For example, the switching device may include a bipolar junction transistor (BJT) or an insulated gate bipolar transistor (IGBT).

Also, the first and second batteries 121 and 122 may be connected to the controller 130. The controller 130 may output a switching signal of the switching device of the boost converter. Also, the controller 130 may control the first and second batteries 121 and 122 so that a voltage of the first battery 121 is supplied to the first driving part 160, and a voltage of the second battery 122 is supplied to the second driving part 161.

Thus, the maximum DC voltage outputted from the first battery 121 may be above about 84.8 V, and the voltage outputted from the first battery 121 may be provided to the suction motor 161 by the controller 130. Also, the controller 130 may control an operation of the suction motor 161.

Since a high voltage of about 84.8 V or more is supplied to the suction motor 161 in the current embodiment, the suction motor may realize a high output. Thus, the suction force of the vacuum cleaner 1 may increase to improve cleaning performance.

In the current embodiment, since the first battery 121 is electrically connected to the cleaner connector 102, and the first battery 121 has the maximum charging voltage of about 84.8 V or more, an isolated boost converter for electrical insulation of the cleaner connector 102 may be used. The isolated boost converter may be a converter in which an inductor is replaced with a transformer.

For another example, a transformer may be disposed between the boost converter and the first battery 121.

In this case, the boost converter may primarily boost the output voltage of the charger 30, and the transformer may secondarily boost the output voltage of the boost converter.

For another example, the boost converter may boost the output voltage of the charger 30, and the transformer may output the same voltage as the output voltage of the boost converter. In either case, the first battery 121 may have the maximum charging voltage of about 84.8 V or more.

In the case where the transformer is used, the transformer may perform the insulation function regardless of a kind of boost converter. As a result, the cleaner connector 102 may be insulated.

According to the proposed embodiment, since the suction motor receives a power from the first battery 121 having the high maximum charging voltage to operate, the high-output suction motor may be used.

Also, since the voltage of the first battery having the high maximum charging voltage is supplied to the first driving part, and the voltage of the second battery having the maximum charging voltage less than that of the first battery is supplied to the second driving part, a charging time for each of the batteries may be reduced.

Since the charging time for each of the batteries is reduced, a use time of the cleaner may increase after each of the batteries is charged once.

Figure 3:
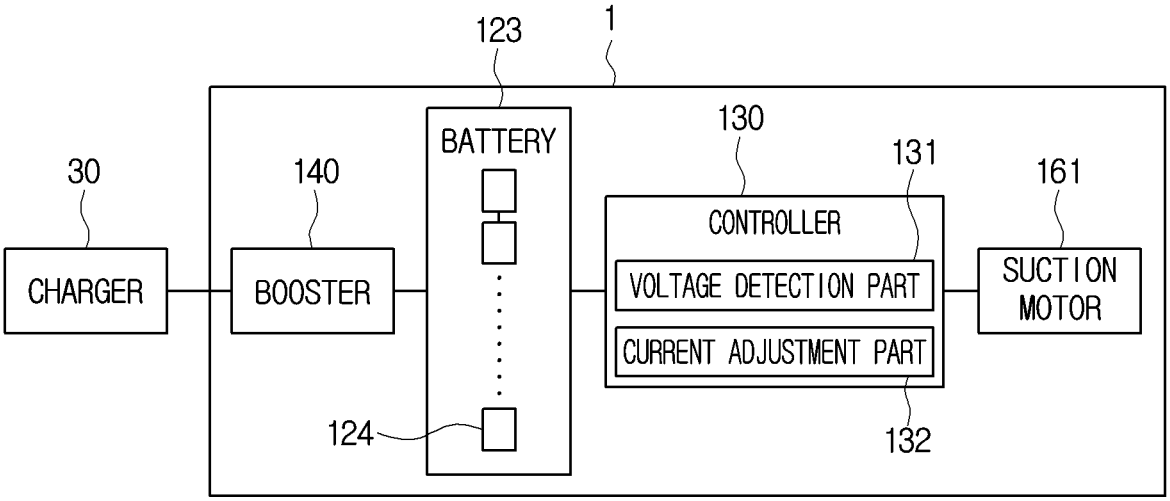
FIG. 3 is a block diagram of a vacuum cleaner according to a second embodiment.

FIG. 3 is a block diagram of a vacuum cleaner according to a second embodiment.

In descriptions of the current embodiment, the same part as that of the first embodiment will use the same constitution and reference numeral of the first embodiment.

Referring to FIG. 3, a vacuum cleaner 1 according to the current embodiment may include a charger 30, a booster 140, a battery 123, a controller 130, and a suction motor 161.

Since the charger 30, the booster 140, and the suction motor 161 have the same as those of the first embodiment, their detailed descriptions will be omitted.

The battery 123 may include a plurality of unit cells 124 that are connected to each other in series. The plurality of unit cells 124 may be maintained and managed to a constant voltage by a battery management system (BMS) (now shown). The battery 123 may have, for example, a maximum charging voltage of about 84.8 V or more.

The controller 130 may control an operation of the suction motor 161. Also, the controller 130 may detect an output voltage of the battery 123 to allow the output of the suction motor 161 to vary. For example, the controller 130 may control the suction motor 161 so that the output of the suction motor 161 is uniformly maintained or decrease.

Also, the controller 130 may detect a voltage of the battery 123 to control a voltage applied to the suction motor 161 and prevent the battery 123 from increasing in temperature when the battery 123 is discharged.

Particularly, the controller 130 may include a detection part 131 for detecting the voltage of the battery 123 and a current adjustment part 132 that adjusts the current of the battery 123 to adjust current applied to the suction motor 132.

The suction motor 161 may have a maximum output of about 600 W or more, but is not limited thereto.

Hereinafter, a method of controlling the vacuum cleaner will be described.

Figure 4:
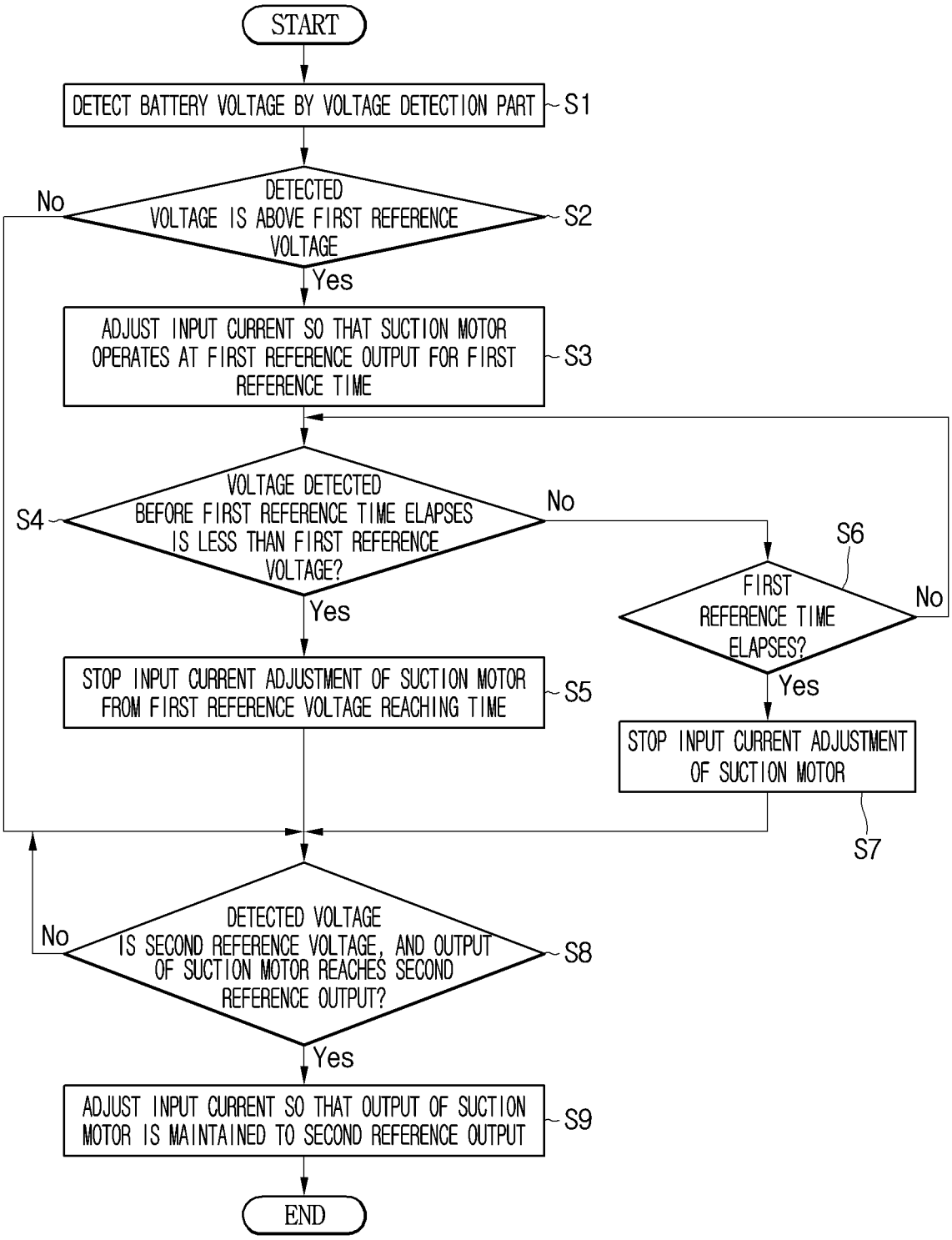
FIG. 4 is a flowchart for explaining a method of controlling the vacuum cleaner according to the second embodiment.

FIG. 4 is a flowchart for explaining a method of controlling the vacuum cleaner according to the second embodiment.

Referring to FIG. 4, when a cleaning start command is inputted into the vacuum cleaner, a voltage of the battery 123 is supplied to the suction motor 161, and thus, the suction motor 161 operates.

Hereinafter, although not limited, it is assumed that the battery 123 has a maximum charging voltage of about 92.4 V, and the suction motor 160 has a maximum output of about 680 W.

Then, in operation S1, the voltage of the battery 123 is detected by a voltage detection part 131 of the controller 130.

In operation S2, the controller 130 may determine whether the voltage of the battery, which is detected by the voltage detection part 131, is above a first reference voltage.

The first reference voltage may be less than a maximum charging voltage of the battery 123, for example, about 85 V, but is not limited thereto.

According to the result determined in the operation S2, if the voltage of the battery, which is detected by the voltage detection part 131, is above the first reference voltage, the controller 130 may adjust an output of the suction motor 161 so that the suction motor 161 operates at a first reference output for a first reference time. Particularly, since a current adjustment part 132 adjusts current inputted into the suction motor 161, an output of the suction motor may be maintained to the first reference output in operation S3. Here, the first reference output may be a maximum output of the suction motor 161.

In general, if a temperature of the battery 123 becomes to a reference temperature (example, about 55 degrees, but is not limited thereto) when the battery 123 is discharged, the battery 123 may not be charged by a protection circuit disposed in a battery management device until the temperature of the battery 123 is lower than the reference temperature regardless of a residual changing amount of battery 123. In this case, to charge the battery 123, the battery 123 has to stand by until the temperature thereof decreases. Thus, a charging time of the battery 123 may increase.

Thus, to prevent the charging time of the battery 123 from increasing, it may be necessary to restrict the temperature of the battery 123.

Also, although not limited, when the current of the battery 123 is above about 1 A, possibility in which the temperature of the battery 123 exceeds the reference temperature may be high.

In the current embodiment, when the voltage of the battery 123 is above the first reference voltage, input current of the suction motor 161 may be adjusted so that the suction motor 161 operates at the first reference output.

For example, when the battery 123 is charged to have the maximum charging voltage, the battery 123 may have an initial voltage of about 92.4 V. In this case, to allow the suction motor 161 to realize an output of about 680 W, current inputted into the suction motor 161 may be about 7.36 A.

Also, when the suction motor 161 continuously operates, the voltage of the battery 123 may decrease. For example, when the voltage of the battery 123 is lowered to about 88 V that is higher than the first reference voltage, the current inputted into the suction motor 161 may be maintained to about 7.36 A, and the output of the suction motor 161 may be reduced to about 647 W.

However, in the current embodiment, the current adjustment part 131 may increase the input current of the suction motor 161 to allow the output of the suction motor 161 to be maintained to the first reference output.

However, when the voltage of the battery 123 reaches about 85 V that is the first reference voltage, the input current of the suction motor 161 may become to about 8 V so that the output of the suction motor 161 becomes to the first reference output.

As described above, when the input current of the suction motor 161 is about 8 V, the temperature of the battery 123 may exceed the reference temperature.

Thus, if the voltage of the battery 123 is less than the first reference voltage in the current embodiment, the input current adjustment of the suction motor 161 may be stopped.

Particularly, while the input current of the suction motor 161 is adjusted to maintain the output of the suction motor 161 to the first reference output in operation S3, the controller 130 may determine whether the voltage of the battery 123 is less than the first reference voltage before the first reference time elapses in operation S4.

According to the result determined in the operation S4, if the voltage of the battery 123 is less than the first reference voltage before the first reference time elapses, the controller 130 may stop the input current adjustment of the suction motor 161 at a time point at which the voltage of the battery 123 is less than the first reference voltage in operation S5.

Also, according to the result determined in the operation S4, if the voltage of the battery 123 is not less than the reference voltage before the first reference time elapses, the controller 130 may determine whether the first reference time elapses in operation S6.

According to the result determined in the operation S6, if it is determined that the first reference time elapses, the controller 130 stops the input current adjustment of the suction motor 161 in operation S7.

As described in the operation S5 or S7, when the input current adjustment of the suction motor 161 is stopped, the voltage of the battery 123 may decrease to reduce the output of the suction motor 161.

In operation S8, the controller 130 determines whether the voltage of the battery 123 is a second reference voltage, and the output of the suction motor 161 reaches a second reference output that is less than the first reference output.

Also, according to the result determined in the operation S2, when the voltage of the battery 123 is less than the first reference voltage, the process proceeds to operation S8.

Although not limited, in this specification, the second reference voltage may be about 66 V, and the second reference output may be about 400 W.

Of cause, the controller 130 may determine only whether the output of the suction motor 161 reaches the second reference output that is less than the first reference output.

According to the result determined in the operation S8, if the voltage of the battery is less than the second reference voltage, and the output of the suction motor 161 reaches the second reference output that is less than the first reference output, the controller 130 may control the output of the suction motor 161 so that the output of the suction motor 161 is maintained to the second reference output. Particularly, in operation S9, the controller 130 may adjust the input current of the suction motor 161 to control the output of the suction motor 161.

Also, when the voltage of the battery 123 reaches a third reference voltage (a limit voltage) that is less than the second reference voltage, the controller 130 may stop the operation of the suction motor 161 and allow an alarm part (not shown) to generate charging request information of the battery. Although not limited, the third reference voltage may be about 50 V.

According to the proposed embodiment, when the voltage of the battery 123 is above the first reference voltage, since the current of the suction motor is adjusted so that the output of the suction motor 161 is maintained to the first reference output, a state in which a output force of the suction motor is maximized may be maintained.

Also, if the voltage of the battery 123 is less than the first reference voltage, or a current adjustment time elapses the first reference time, the input current adjustment of the suction motor 161 may be stopped to prevent the temperature of the battery 123 from exceeding the reference temperature.

Also, when the output of the suction motor 161 reaches the second reference output that is less than the first reference output, the controller 130 adjusts the input current of the suction motor 161 so that the output of the suction motor 161 is maintained to the second reference output. Thus, the output of the suction motor 161 may be continuously reduced to prevent the suction force from being continuously reduced, thereby continuously performing the cleaning until the charging of the battery is required.

The adjustment of the output of the suction motor by using the controller described in the current embodiment may be equally applied to the first embodiment. Here, the battery according to the current embodiment may correspond to the first battery according to the first embodiment, and the suction motor according to the current embodiment may correspond to the suction motor constituting the first driving part according to the first embodiment.

At least one of the first to third reference voltages and the first and second reference outputs may vary according to the maximum charging voltage of the battery and the maximum output of the suction motor.

Figure 5:
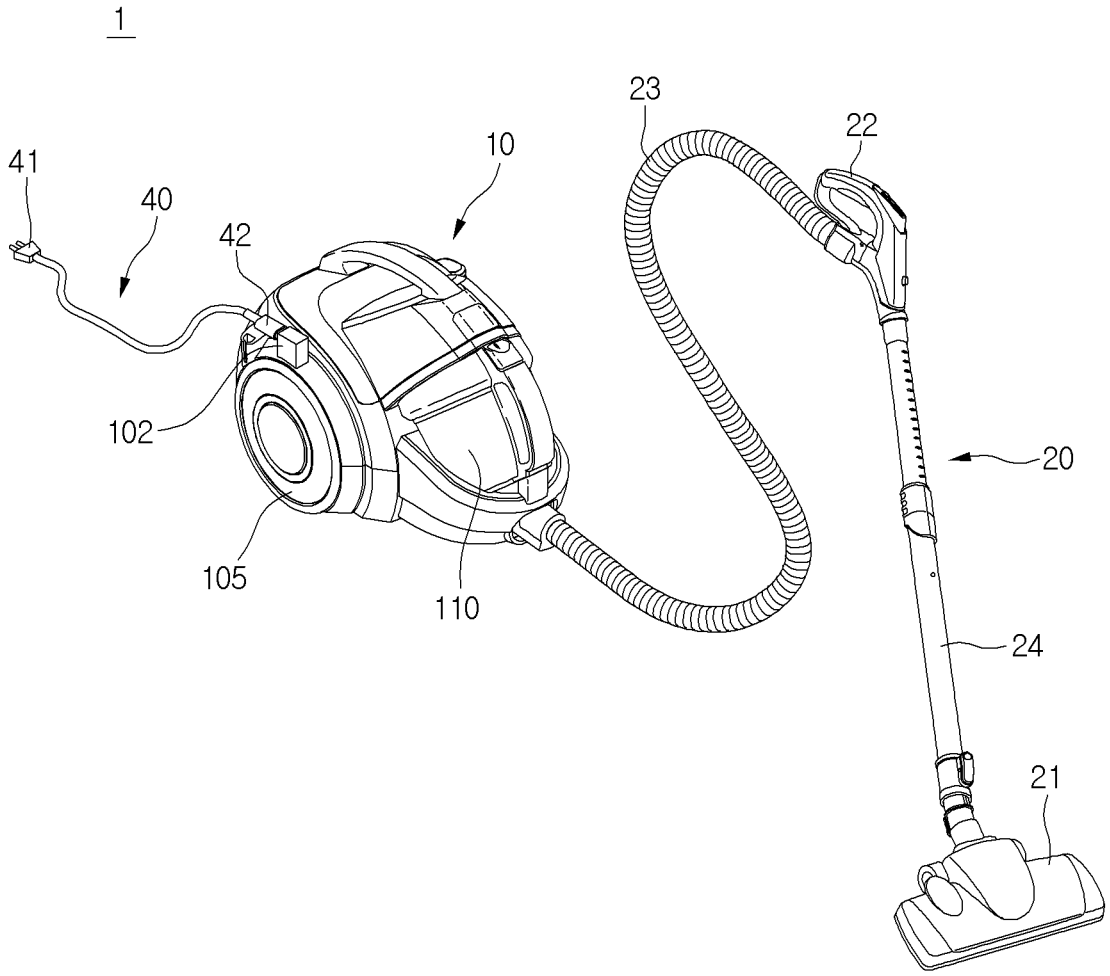
FIG. 5 is a perspective view of a vacuum cleaner according to a third embodiment.
Figure 6:
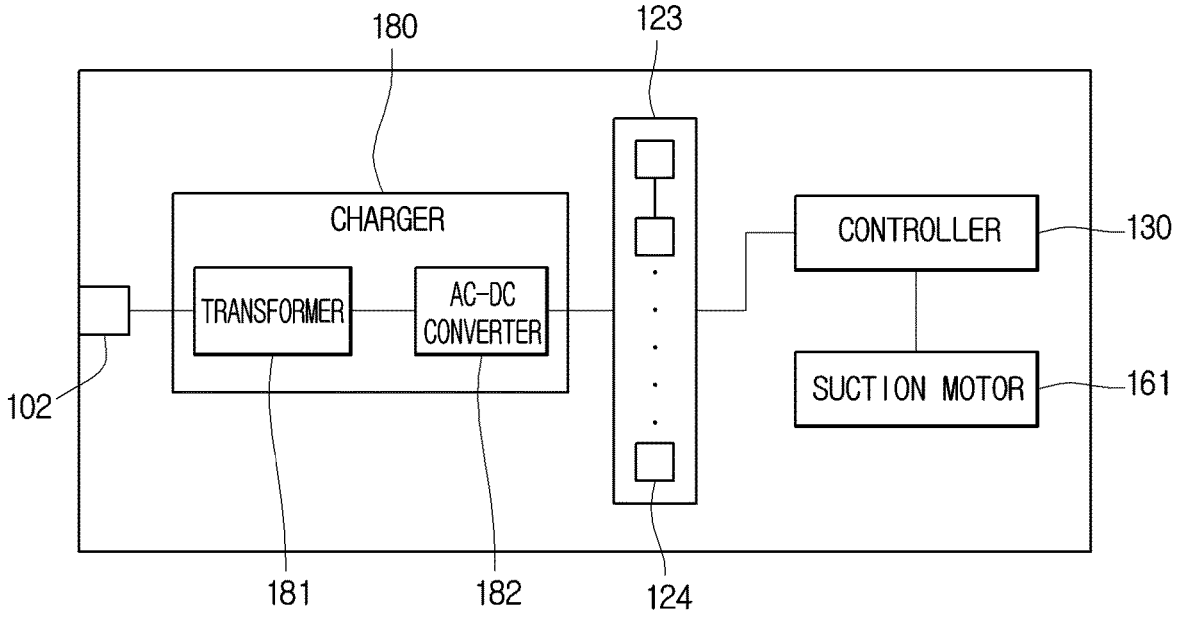
FIG. 6 is a block diagram of the vacuum cleaner according to the third embodiment.

FIG. 5 is a perspective view of a vacuum cleaner according to a third embodiment, and FIG. 6 is a block diagram of the vacuum cleaner according to the third embodiment.

Referring to FIGS. 5 and 6, a vacuum cleaner 1 according to the current embodiment may include a cleaner body 10 including a suction motor 161 for generating a suction force and a suction device 20 for guiding air containing dusts to the cleaner body 10.

The suction device 20 may include a suction part 21 for suctioning dusts disposed on a surface to be cleaned, for example, a bottom surface and connection parts 22, 23, and 24 for connecting the suction part 21 to the cleaner body 10.

The connection part 22, 23, and 24 may include an extension tube 24 connected to the suction part 21, a handle 22 connected to the extension part 24, and a suction hose 23 connecting the handle 22 to the cleaner body 10.

Also, the vacuum cleaner 1 may further include a dust separation part (not shown) for separating dusts from air suctioned by the suction device 20 and a dust container 110 for storing the dusts separated by the dust separation part. The dust container 110 may be separably mounted on the cleaner body 10. The dust separation part may be provided as a separate part that is separated from the dust container 110 or be provided as one module together with the dust container 110.

The vacuum cleaner 1 may include a battery 123 supplying a power for operating the suction motor 161, a charger 180 for charging the battery 123, and a power cord 40 separably connected to the cleaner body 10 and supplying a commercial power into the cleaner body 10.

The power cord 40 may include a plug 41 connected to a socket and a first connector 42 connected to the cleaner body 10. Also, the cleaner body 10 may include a cleaner connector 102 connected to the first connector 42.

The battery 123 may include a plurality of unit cells 124 that are connected to each other in series. The plurality of unit cells 121 may be maintained and managed to a constant voltage by a battery management system (BMS) (now shown). The battery 123 may have, for example, a maximum charging voltage of about 84.8 V or more.

The charger 180 may perform rectification and smoothing operations to convert a commercial AC voltage into a DC voltage. Also, the charger 180 may supply the converted DC voltage to the battery 123. For example, the charger 180 may convert a commercial AC voltage of 42.4 V into a DC voltage that exceeds about 42.4 V to supply the converted DC voltage to battery 123.

The charger 180 may be disposed on the cleaner body 10, the suction part 21, or the handle 22.

The charger 180 may include a transformer 181 for converting the inputted AC voltage and an AC-DC converter 182 for converting an AC voltage outputted from the transformer 181 into a DC voltage. Here, the DC voltage outputted from the AC-DC converter 182 may exceed about 42.4 V.

For another example, the DC voltage outputted from the AC-DC converter may be converted by the transformer. In this case, a DC voltage outputted from the transformer 181 may exceed about 42.4 V.

For another example, the charger 180 may not include the transformer, and the AC-DC converter 182 may include a circuit for preventing the DC voltage from being converted into the AC voltage. That is, the AC-DC converter 182 may be an isolated converter. In the current embodiment, since the wall-known converter is used as the AC-DC converter, detailed description thereof will be omitted.

In the current embodiment, the suction motor 161 may be, for example, a BLDC motor. Also, the suction motor 161 may have a maximum output of about 600 W or more, but is not limited thereto.

Since the high-output suction motor 161 is used in the current embodiment, the suction force of the cleaner may increase.

Also, in the current embodiment, the controller 130 may perform the same function as that of the controller 130 according to the second embodiment. That is, when the voltage of the battery 123 is above the first reference voltage, the controller 130 may adjust the current of the suction motor so that the output of the suction motor 161 is maintained to the first reference output.

Also, when the voltage of the battery 123 is below the first reference voltage, or the current adjustment time elapses the first reference time, the controller 130 may stop the input current adjustment of the suction motor 161.

Also, when the output of the suction motor 161 reaches the second reference output that is less than the first reference output, the controller 130 may adjust the input current of the suction motor 161 so that the output of the suction motor 161 is maintained to the second reference output.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a cleaner body;

a suction part fastened to the cleaner body, the suction part to communicate with the cleaner body to suction air and dust particles;

a first battery disposed on the cleaner body or the suction part, the first battery having a first maximum charging voltage;

a second battery disposed on the cleaner body or the suction part, the second battery having a second maximum charging voltage that is less than the first maximum charging voltage;

a first driving part to receive power from the first battery, the first driving part comprising a suction motor to generate suction; and a second driving part to receive power from the second battery, the second driving part comprising at least a brush driving part for driving a brush, wherein the first driving part is continuously driven, and wherein the second driving part only operates when a specific condition is satisfied, further comprising;

a charger separably connected to the cleaner body or the suction part to charge the first and second batteries;

a booster that increases a voltage outputted from the charger to supply the increased voltage to only the first battery; and a transformer disposed between the booster and the first battery;

whereby the booster primarily boosts the output voltage of the charger, and the transformer secondarily boosts the output voltage of the booster.

2. The vacuum cleaner according to claim 1, wherein the second driving part is switched from an off state to an on state, or from the on state to the off state, while the first driving part operates.

3. The vacuum cleaner according to claim 1, wherein the booster comprises a boost converter.

* * * * *